US007710327B2

(12) United States Patent
Saban et al.

(10) Patent No.: US 7,710,327 B2
(45) Date of Patent: May 4, 2010

(54) MULTI BAND INDOOR ANTENNA

(75) Inventors: Ofer Saban, Quidron (IL); Benny Almog, Beit Arye (IL)

(73) Assignee: Mobile Access Networks Ltd., Lod (IL)

( * ) Notice: Subject to any disclaimer, the term of this patent is extended or adjusted under 35 U.S.C. 154(b) by 611 days.

(21) Appl. No.: 11/558,913

(22) Filed: Nov. 12, 2006

(65) Prior Publication Data

US 2007/0109198 A1 May 17, 2007

Related U.S. Application Data

(60) Provisional application No. 60/735,867, filed on Nov. 14, 2005.

(51) Int. Cl.
*H01Q 1/38* (2006.01)

(52) U.S. Cl. ..... 343/700 MS; 343/702

(58) Field of Classification Search ..... None
See application file for complete search history.

(56) References Cited

U.S. PATENT DOCUMENTS

| | | | | |
|---|---|---|---|---|
| 4,675,690 | A | 6/1987 | Hoffman | |
| 6,864,844 | B2 * | 3/2005 | Sato | 343/702 |
| 2003/0103010 | A1 * | 6/2003 | Boyle | 343/702 |
| 2003/0112188 | A1 * | 6/2003 | Bordi et al. | 343/702 |
| 2003/0201939 | A1 * | 10/2003 | Reece et al. | 343/700 MS |
| 2005/0280586 | A1 * | 12/2005 | Bit-Babik et al. | 343/702 |
| 2006/0232477 | A1 * | 10/2006 | Ollikainen | 343/700 MS |
| 2007/0205947 | A1 * | 9/2007 | Boyle | 343/700 MS |
| 2008/0252538 | A1 * | 10/2008 | Ying | 343/767 |

OTHER PUBLICATIONS

"*Planar Inverted F. Antenna Loaded With High Permittivity Material*", by: Y. Hwang, YP Zhang, GX Zheng and TKC Lo; Electronic Letters Sep. 28, 1995 , vol. 31, No. 20.

"*Modified Planar Inverted F. Antenna*" ; By: Kin-Lu Wong and Kai-Ping Yang; Electronic Letters Jan. 8, 1998; vol. 34, No. 1.

"*A Capacitively Loaded PIFA for Compact Mobile Telephone Handsets*" ; By C. Rowell and R.D. Murch; IEEE Transactions on Antennas and Prop. vol. 45, No. 1. May 1997.

"*A Dual Frequency Antenna Fed By CPW*" IEEE Antenna and Prop Int. Symposum, 2005; G. Chi, B. Li, D. Qi.

*Dual Broadband T-Shaped Monopole Antenna For Wireless Communication* ; Wu, Hsiao, Lu, Wang; IEEE 2005 (Dept of Marine Engineering. Depart of Electronic Engineering and of General Education; National Kaohsiung University, TW.

*Mulit Band Minitiarized PIFA for Compact Wireless-Communication Applications* Microwave and Optical Techn. Letters, vol. 42, No. 3 Aug. 2004; by: H.Elsadek, D. Nashaat and H. Ghall.

"*Wideband Planar Monopole Antennas*"; by: NP Agrawall, G.Kumar and KP Ray; IEEE Trans. Antenna and Propr. vol. 46, No. 2, Feb. 1998.

* cited by examiner

*Primary Examiner*—Trinh V Dinh
(74) *Attorney, Agent, or Firm*—Mark M. Friedman

(57) ABSTRACT

A wide band indoor antenna includes a low band section with four modified spiral (MSE) elements, a high band section with a bent folded monopole (BFM) radiator mounted on a ground plane and a feeding plate for feeding the low band section and the high band section via a diplexer. The BFM radiator mounted on the ground plane can serve independently as a high frequency monopole antenna.

3 Claims, 8 Drawing Sheets

MULTI BAND INDOOR ANTENNA

CROSS REFERENCE TO RELATED APPLICATIONS

The present invention claims priority from U.S. Provisional Patent Application No. 60/735,867, filed 14 Nov. 2005, the contents of which are incorporated herein by reference

FIELD AND BACKGROUND OF THE INVENTION

The present invention refers in general to antennas and in particular to indoor antennas.

Efficient electromagnetic wave propagation, within al indoor environment, requires special attention to antenna pattern aid polarization. The effect of these two factors may be intuitively understood. First, due to the "Near-Far" effect, the antenna needs to emphasize power density towards relatively farther away (distant) users while de-emphasizing power density directed towards relatively close users. Second, in an indoor environment, wave polarization is impacted by reflections, diffraction and scattering, thus creating a significant horizontal component.

Wide band antenna operation may be achieved by many methods and antenna structures. Most, such as Yagi, log periodic or fractal element-based antennas, require relatively complicated structures which are expensive to implement. Elliptical and circular polarization can also achieved by the use of three dimensional radiators such as conical spiral elements, as described for example in U.S. Pat. No. 4,675,690. However, such elements are expensive to produce.

A family of monopole antennas (sometimes called "inverted F antennas"), to which elements in the present invention bear some distant resemblence, is known, see e.g. [1] Y. Hwang, Y. P. Zhang, and T. K. C. Lo "Planar inverted F antenna loaded with high permittivity material", IEEE Electronic Letters, vol. 31, no. 20, September 1995; [2] C. R. Rowell and R. D. Murch, "A Capacitively Loaded PIFA for Compact Mobile Telephone Handsets", IEEE Trans. Antenna and Prop. Vol. 45, no. 5, May 1997; [3] K. L. Wong and K. P. Yang, "Modified planar inverted F antenna", IEEE Electronic Letters, vol. 34, no. 1, January 1998; [4] C. M. Su, K. L. Wong, W. S. Chen, and Y. T. Cheng, "A Microstrip Coupled Printed Inverted-F Monopole Antenna". Microwave and Optical Techn. Letters, vol. 43 no. 6 December 2004; and [5] H. Elsadek, D. Naslhaat and H. Ghall, "Multiband Miniaturized PIFA for Compact Wireless-Communication Applications", Microwave and Optical Technol. Letters, vol. 42, no.3, August 2004, all of which are incorporated herein by reference. These antennas are usually characterized by narrow band operation due to the strong coupling between the physical length of the antenna and its operating wavelength. However, the demanding wireless market requires continued miniaturization and increased operating bandwidth. The literature reports several solution techniques for miniaturization as well as multiband operation. Nevertheless these solutions, which use several resonance frequencies established by parasitic and multi-element construction, are not truly wide band. These solutions also lack stable radiation patterns over their resonance frequency (see FIG. 3 in (ref. [1], FIG. 7 in ref. [2] and FIG. 9 in ref. [5]), thereby enforcing a non-optimal frequency and spatial coverage.

Some attempts have been made to enlarge the frequency bandwidth, see e.g. [6] N. P. Agrawall, G. Kumar, K. P. Ray, "Wide Band Planar Monopole Antennas", IEEE Trans. Antenna and Prop. Vol. 46, no. 2, February 1998; [71] J. Liang, C. C. Chiau, X. Chen, C. G. Parini, "CPW-fed circular ring monopole antenna", IEEE Antenna and Prop Int. Symp. 2005; [8] and G. Chi, B. Li, D, Qi, "A Dual-frequency Antenna Fed by CPW", IEEE Antenna and Prop Int. Symp. 2005, all of which are incorporated herein by reference. The antennas described in [6] and [7] are broadband, however their azimuthal pattern variation exceeds 7dB, and therefore they cannot be considered as omni-directional. The antenna in [8] lacks both wide bandwidth (more then 50%) and omni-directional radiation pattern.

In view of the disadvantages of known antennas in terms of bandwidth and omni-directional operation, there is a need for, and it would be beneficial to have an antenna that does not suffer from these disadvantages. In particular, it would be advantageous to have antennas with circular polarization and/or a significant horizontal component for indoor use.

SUMMARY OF THE INVENTION

The present invention discloses a unique and novel omni-directional antenna able to truly provide wide-band characteristics and uniform performance with low cost and small size implementation.

According to the present invention there is provided a wide band indoor antenna including a low band section used for operation in a low frequency band, a high band section having a bent folded monopole (BFM) radiator mounted on a ground plane and used for operation in a high frequency band and a feeding plate for feeding the low band section and the high band section via a diplexer.

In some embodiments of the antenna, the low band section includes four modified spiral element (MSE) radiators.

In some embodiments of the antenna, each MSE radiator includes two semi-spiral conductive elements formed on opposite sides of a non-conductive substrate and a transmission line for feeding each semi-spiral element through respective feeding points.

In some embodiments of the antenna, the semi-spiral elements are printed on the substrate.

In some embodiments of the antenna, each semi-spiral element has a predetermined shape.

In some embodiments of the antenna, each semi-spiral element with a predetermined shape is characterized by predetermined dimensions.

In some embodiments of the antenna, the shape and dimensions of each semi-spiral element are scaled relative to the predetermined shape and dimensions by a factor.

In some embodiments of the antenna, the factor includes a multiplication of a predetermined scale parameter mid a frequency parameter.

In some embodiments of the antenna, the BFM radiator includes conductive side plates and conductive folded plates joined by conductive top plates in a parallel inverted asymmetric U structure, In some embodiments of the antenna, the BFM radiator includes conductive side plates and conductive folded plates joined by conductive top plates in a non-parallel inverted asymmetric U structure.

In some embodiments of the antenna, the BFM radiator further includes at least one shunt point and a feed point.

In some embodiments of the antenna, the diplexer includes two branches, a first branch acting as a low pass filter and used to connect the low band section to an antenna port and a second branch acting as a high pass filter and used to connect the high band section to the same antenna port.

In some embodiments of the antenna, the connection between the high band section and the antenna port includes a transmission line for transforming a BFM radiator impedance to a required impedance.

According to the present invention there is provided a wide band indoor antenna including a low band section that includes four MSE radiators used for operation in a low frequency band, a high band section having a BFM radiator mounted on a ground plane and used for operation in a high frequency band and a feeding plate for feeding the low band section and the high band section via a diplexer.

According to the present invention there is provided a high band antenna comprising a BFM radiator mounted on a ground plane and means for feeding the BFM radiator and for connecting the BFM radiator to an antenna port.

In some embodiments of the high band antenna, the BFM radiator includes conductive side plates and conductive folded plates joined by conductive top plates in a parallel inverted asymmetric U structure.

In some embodiments of the high band antenna, the BFM radiator includes conductive side plates and conductive folded plates joined by conductive top plates in a non-parallel inverted asymmetric U structure.

In some embodiments of the high band antenna, the BFM radiator further includes at least one shunt point and a feed point.

BRIEF DESCRIPTION OF TIHE DRAWINGS

The invention is herein described, by way of example only, with reference to the accompanying drawings, wherein.

DESCRIPTION OF THE PREFERRED EMBODIMENTS

The present invention is of a wide band, omni-directional antenna that includes two novel sections—a low band section and a high band section combined and fed by a novel component. The low and high band sections may serve as antennas for respective frequency bands on their own. The wide band, omni-directional antenna of the present invention (also referred to herein as an indoor antenna) provides high power density directed towards the antenna plane and lower power densities directed perpendicular to the antenna planes The polarization varies between near circular to highly elliptical, depending on the frequency band. The polarization vector lies in the plane perpendicular to the antenna plane. The indoor antenna thus has advantageous properties in an indoor environment.

The principles and operation of the indoor antenna according to the present invention may be better understood with reference to the drawings and the accompanying description.

Figure 1:
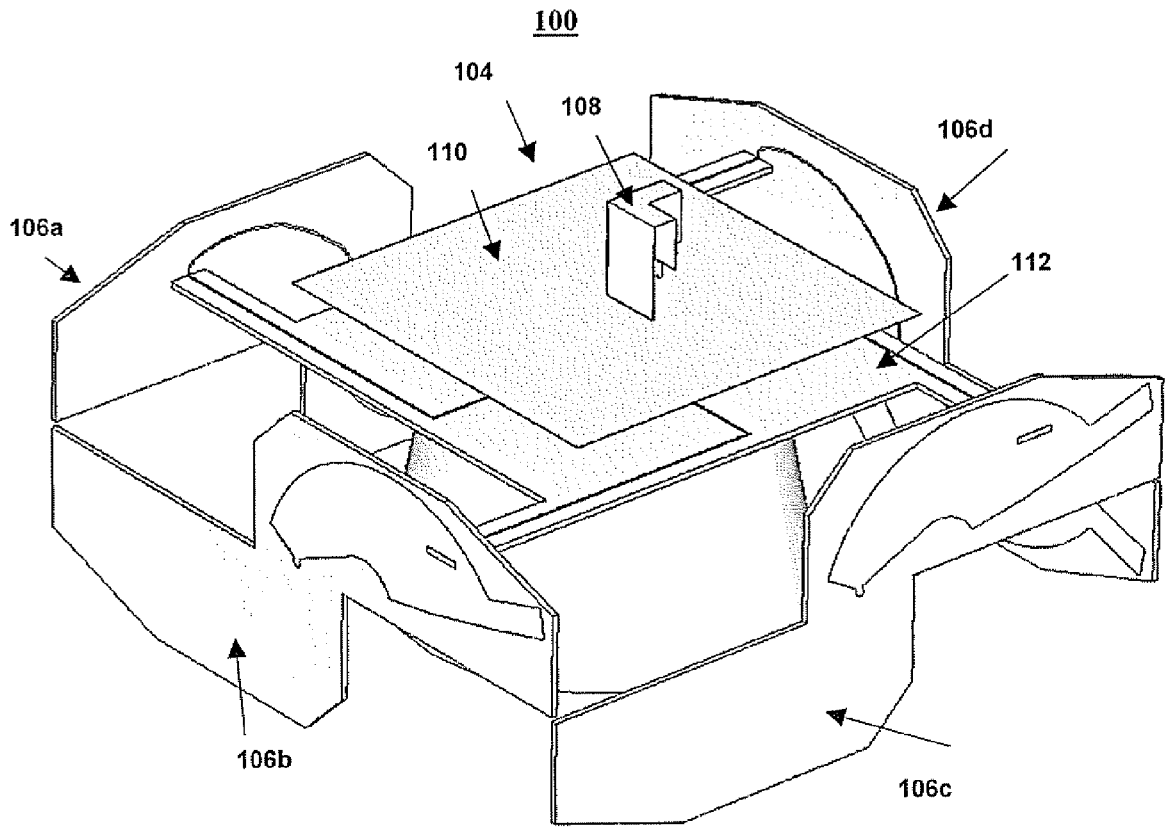
FIG. 1 shows the construction of an antenna of the present invention.

FIG. 1 shows the construction of an indoor antenna 100 of the present invention Antenna 100 includes two main sections, a bottom, low band section 102 formed of four MSE radiators 106*a-d* and a feeding plate 112, and a top, high band section 104, referred to as a "bent folded monopole section" or simply "BFM". MSE radiators 106 are disposed generally in a square pattern, and have unique novel properties imparted by their specific shape and dimensions. BFM 104 includes a novel BFM radiator 108 mounted on a ground plane 110. Sections 102 and 104 are electrically and mechanically connected through feeding plate 112. Each main component of the indoor antenna of the present invention is described in more detail hereinbelow.

Electromagnetic interaction between the low and the high band sections of the antenna will result in distortion of the radiation pattern of both. In order to avoid such interaction, radiator 108 and ground plane 110 are mounted above the level of the low band section 102. Both the high band and the low band sections are designed to have minimal height in order to allow their mounting on separate levels while still keeping the overall antenna height as required by the specification.

The Bent Folded Monopole

Figure 2:
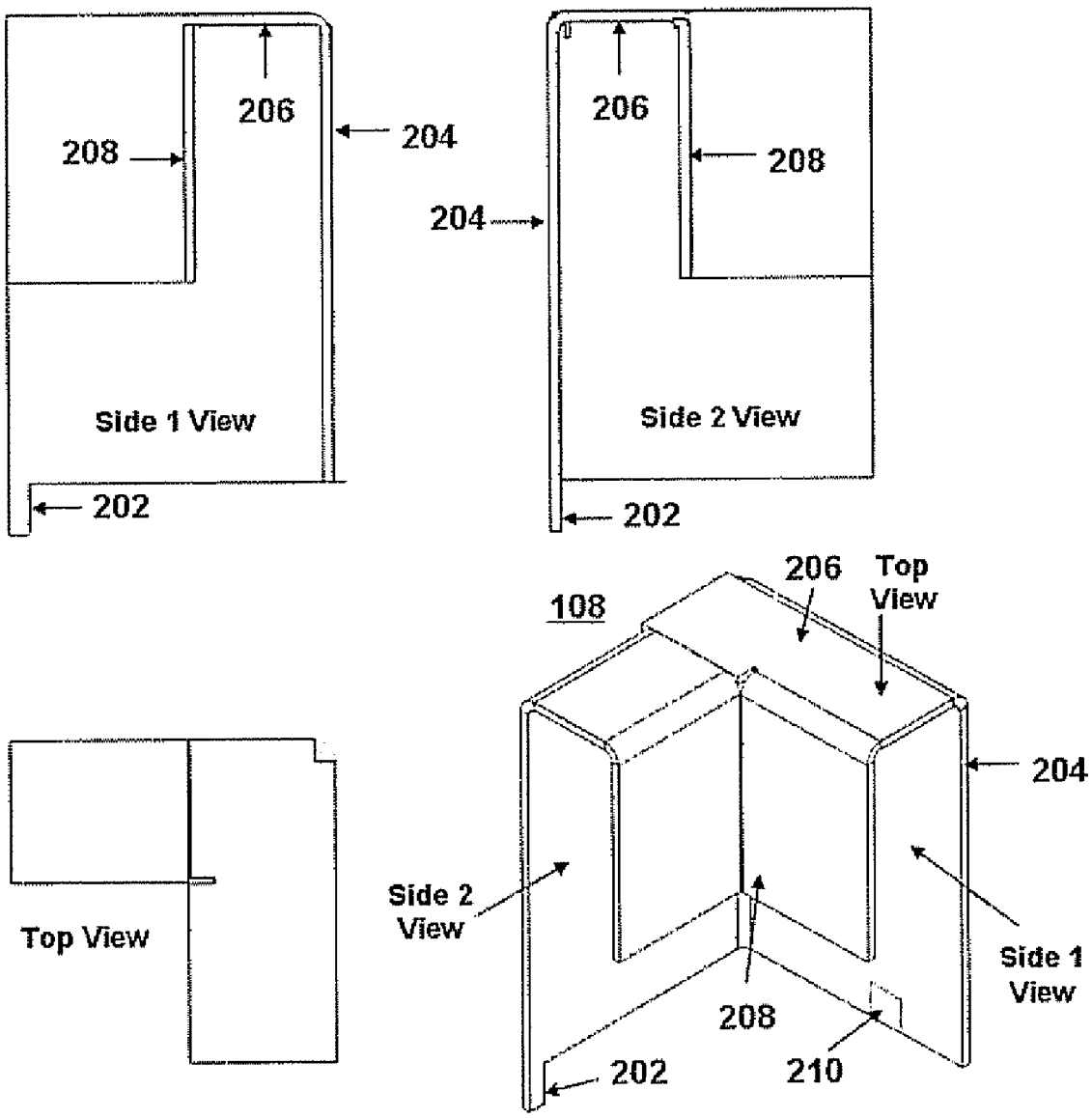
FIG. 2 shows details of a BFM radiator in isometric view and in various cross sections, some with dimensions in mm.
Figure 3:
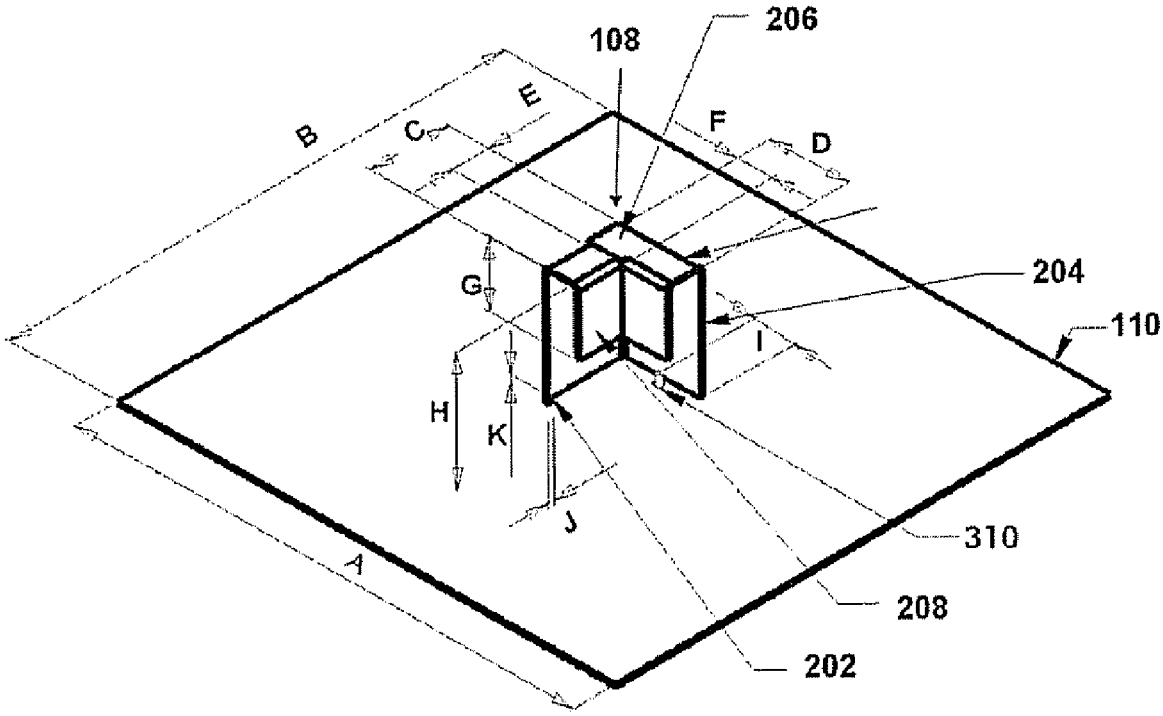
FIG. 3 shows the radiator of FIG. 2 mounted on the ground plane and provides exemplary dimensions for each of the key structural features.

The BFM section is essentially a monopole antenna. In terms of performance characteristics, the BPM needs to provide high gain in an omni-directional radiation pattern and elliptical-vertical polarization. In addition, the height of the BPM should be kept as low as possible, FIG. 2 shows details of BFM radiator 108 in (a) isometric view and (b) various cross sections, some with dimensions in mm. FIG. 3 shows radiator 108 mounted on ground plane 110. Radiator 108 includes at least one shunt point 202, side plates 204, top plates 206, folded plates 208 and a feed point 210, all positioned and interconnected as shown. Top plates 206 provide connection and support to folded plates 208. In some embodiments, such as shown in FIG. 2, folded plates 208 are parallel to side plates 204. From a side view (FIG. 2, side views 1 and 2), the structure looks like an inverted U, with one arm (of the folded plates) shorter than the other (of the side plates). We will therefore refer to this structure as a "parallel inverted asymmetric U" structure. In other embodiments (not shown), folded plates 208 may diverge in their parallel orientation to side plates 204 by up to 25 degrees. In this case the arms of the "U" are not parallel, and the structure is referred to as a "non-parallel inverted asymmetric U" structure.

The radiator is mounted on ground plane 110, which may have any arbitrary shape and dimensions as long as its minimal width and length are longer than the half wavelength of the minimum frequency served by the BFM. Each shunt point is electrically connected to the ground plane. The feed point is used to provide energy to the BFM and is isolated from the ground plane. Side plates 204 are oriented upwards from the ground plane mid supported by the shunt point(s) and the feed point. In some embodiments, their upward orientation is perpendicular to the ground plane. In other embodiments, their orientation may diverge by up to 25 degrees from the perpendicular orientation to the ground plane.

Preferably, all surfaces of BFM radiator 108 are conductive, made examplarily from a metal or other conductive materilas such as a conductive ink applied over a non-conductive substrate. In some embodiments, BFM radiator 108 may be made of a single metal sheet, folded to produce the structure shown. In other embodiments, as shown in FIG. 2, the radiator may be made of separate pieces, joined for example by welding. The metal may exemplarily be a 1 mm-thick tin plated iron sheet. An exemplary set of values (in millimeters) for the dimensions given by letters A-K in FIG. 3 is given in Table I below. These values are for a BFM used for radiation in the range of 1700 MHz to 6000 MHz. Note that these dimensions are provided only for enablement purposes, and it should be clear to one skilled in the art that other dimensions obtained through proper scaling can provide similar antennas with adequate performance. Operation in this frequency band may be successfully performed with a different optimal set of dimensions, which can be changed by up to +/− 20% relative to the dimesions in Table I. Operation in other frequency bands may also be successfully performed with a yet different scaled set of dimensions. The scaling involves rules well known to those skilled in the art.

TABLE I

| Designation | Dimensions (mm) |
|---|---|
| A | 100 |
| B | 100 |
| C | 16 |
| D | 16 |
| E | 7.25 |
| F | 7 |
| G | 13.25 |
| H | 24.25 |
| I | 8 |
| J | 1 |
| K | 1 |

The following unique characteristics are enabled by the construction described herein:

1. The BPM of the present invention is structured and operable to provide a decrease of return loss for wider bandwidth in comparison with antennas having the same structure but lacking the at least one shunt point 202.

2. The BPM of the present invention is structured and operable to provide decrease of return loss for wider bandwidth in comparison with antennas having the same structure but lacking of top plates or folded plates 204.

3. The BPM of the present invention is structured and operable to provide omni-directional coverage for wider bandwidth in comparison with antennas having the same structure but lacking of side plates 208.

The unique shape of the BPM reduces the nulls in the radiation pattern (which exists in practically all known "Inverted F" antennas) and provides an additional gain of about 2 db over a "conventional" monopole antenna at low angles relative to the horizon. It also produces vertical and horizontal electric fields, thus achieving the required elliptical-vertical polarization.

The Modified Spiral Element (MSE) Radiator

As stated, the low band antenna section includes four MSE radiators arranged as shown in FIG. 1, in order to achieve omni-directional coverage. Details of a single MSE radiator are given in FIGS. 4 and 5, which show respectively "front" and "back" views, An MSE radiator includes a non-conductive (e.g. printed circuit board or PCB) substrate 402 with two "semi-spiral" conductive elements 404 (FIG. 4) and 502 (FIG. 5) printed on opposite sides (front and back respectively) of the PCB. Note that FIG. 5 is obtained by "flipping" FIG. 4 by 180 degrees around a horizontal axis. Element 404 is fed through a printed transmission line 406 which gets its signal from the feeding network (see below) and a feeding point 408. Element 502 is fed through another feeding point 504 (which is actually the other side of feeding point 408).

Figure 4:
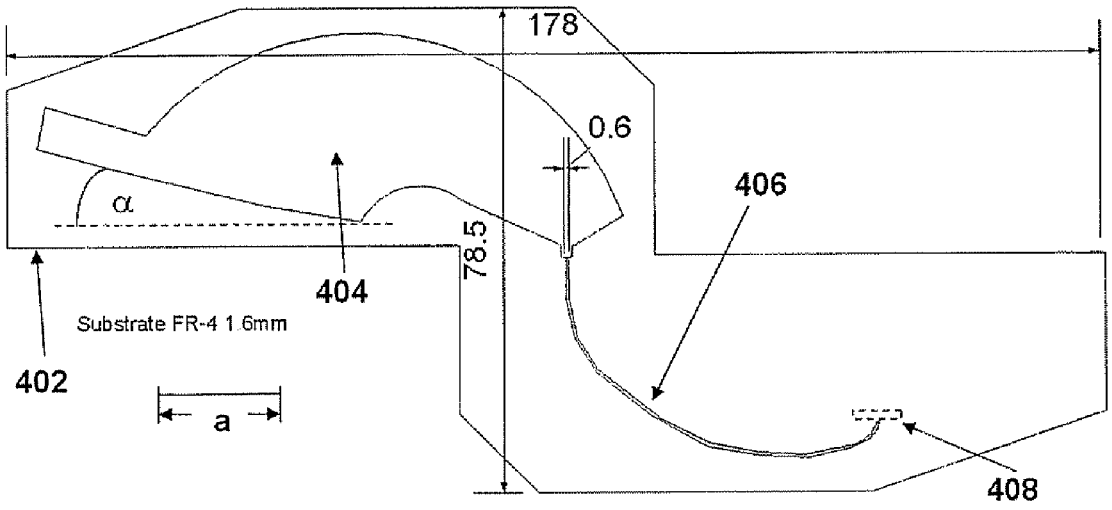
FIG. 4 shows a front view of a MSE radiator.
Figure 5:
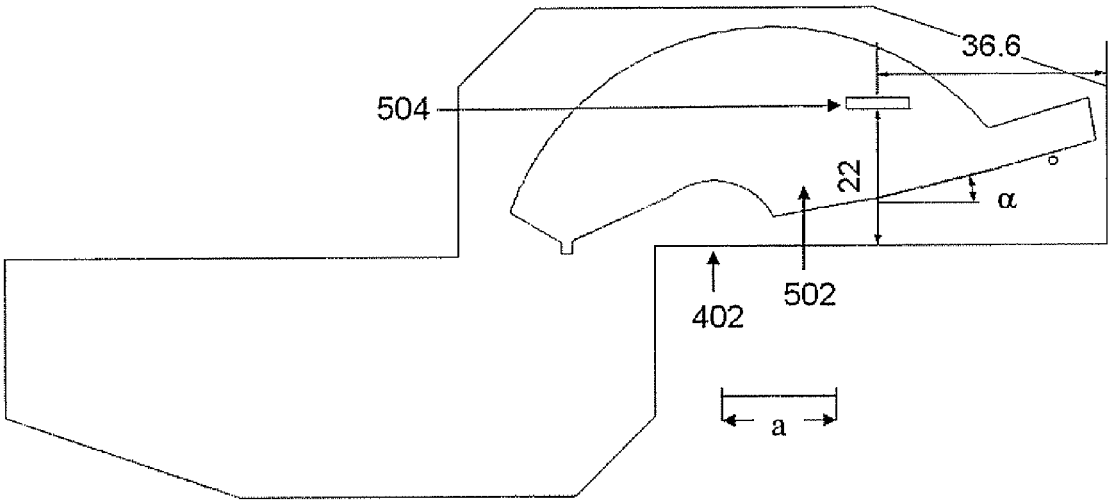
FIG. 5 shows a back view of a MSE radiator.

The MSE radiator aid conductive elements shapes and dimensions shown in FIGS. 4 and 5 are referred to herein as "predetermined shapes" and "predetermined dimensions" respectively. In particular, a bar marked "a" is a reference length unit, through which all other dimensions may be reproduced. In the particular example shown in these figures, a=2 cm. In general, the predetermined dimensions can be scaled (the shape remaining unchanged). A preferred scaling rule is given by $a'=a\times 600/f$, where a' is the reference length unit in the scaled MSE radiator, a is as defined above, and f is the lower operation frequency for the scaled antenna in MHz In other words, a may be considered a scale parameter and f may be considered a frequency parameter. Examplarily, if a=2 cm and f=1200 MHz, then a' equals 1 cm. A+/− 10 percent change of any dimension of the shape is tolerable.

The MSE radiator of the present invention is unique and novel in its "modified spiral" shape, which was developed in order to achieve the required performance in a wide frequency band (600 Mhz to 1700 MHz). The "modified spiral" term reflects a design change relative to the traditional spiral antennas, of the type disclosed in U.S. Pat. No. 4,675,690. The modification relates mainly to the feed mechanism, the shape and the size of the antenna, which must comply with low-cost, small-size design requirements.

Note that the opposing elements (conductive elements 404 (FIG. 4) and 502) are actually with 180° phase difference. Therefore, frequency independent nulls are aimed towards the zenith and nadir Note also that the polarization characteristics of the elements enable a compact shape while maintaining very low mutual coupling between the elements. This characteristic is essential to maintain a stable elevation pattern over a large frequency band and is achieved by a combination of compact array size and tilted elements.

The PCB substrate may be made from a low cost material such as 1.6 mm-thick FR-4-1OZ. Other materials call be used with proper scaling according to their dielectric coefficient, as well known in the art.

An important characteristic of the shape is its tilt $\alpha$ relative to the horizon. This tilt provides the necessary isolation between the radiators and adds to the "circular polarization" nature of the antenna, $\alpha$ is preferably 10 degrees, but 5-20 degrees will also provide good performance.

Low Loss Diplexing (Combing/Splitting) of the Two Parts of the Antenna

Figure 6:
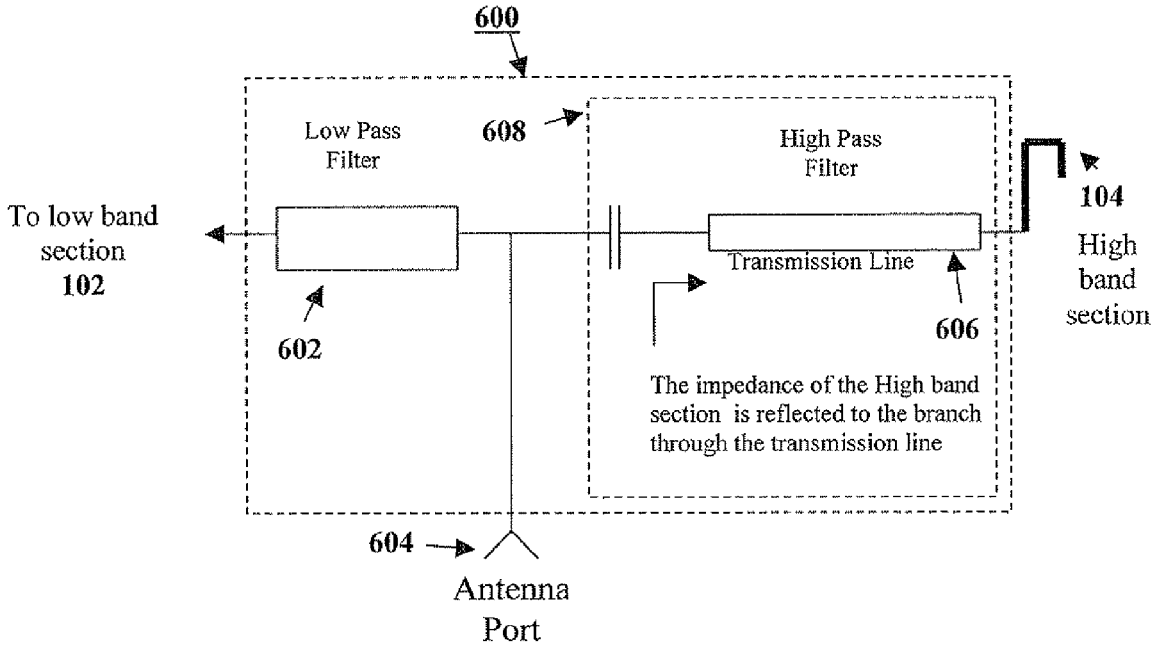
FIG. 6 shows a schematic diagram of a diplexer, which connects the antenna port to the high and low band sections of the antenna.

FIG. 6 shows a schematic diagram of the diplexer 600—the electrical circuit connecting the low band and the high band antenna sections to an antenna port. The diplexer has two branches 602 and 608. Branch 602 acts as a low pass filter and connects antenna port 604 to low band section 102. Branch 608 acts as an high pass filter and connects the antenna port to high band section 104. In order to minimize the losses of the high band section, it is essential to minimize the part count of this branch In the present invention this is done by replacing a real coil (normally found in such a diplexer branch) with the reflected impedance of section 104 itself. The transformation of the BFM impedance to the required impedance is done through a transmission line 606 that connects section 104 to the antenna port. The length of the transmission line is designed to create the required transformation ratio. For example, feeding a BFM that operates in 1700 MHz-6000

MHz band requires a 53 mm, 50 Ohm coaxial transmission line. The diplexer is mounted on a feeding plate 700 (FIG. 7 and same as 112 in FIG. 1).

The Feeding Plate

Figure 7:
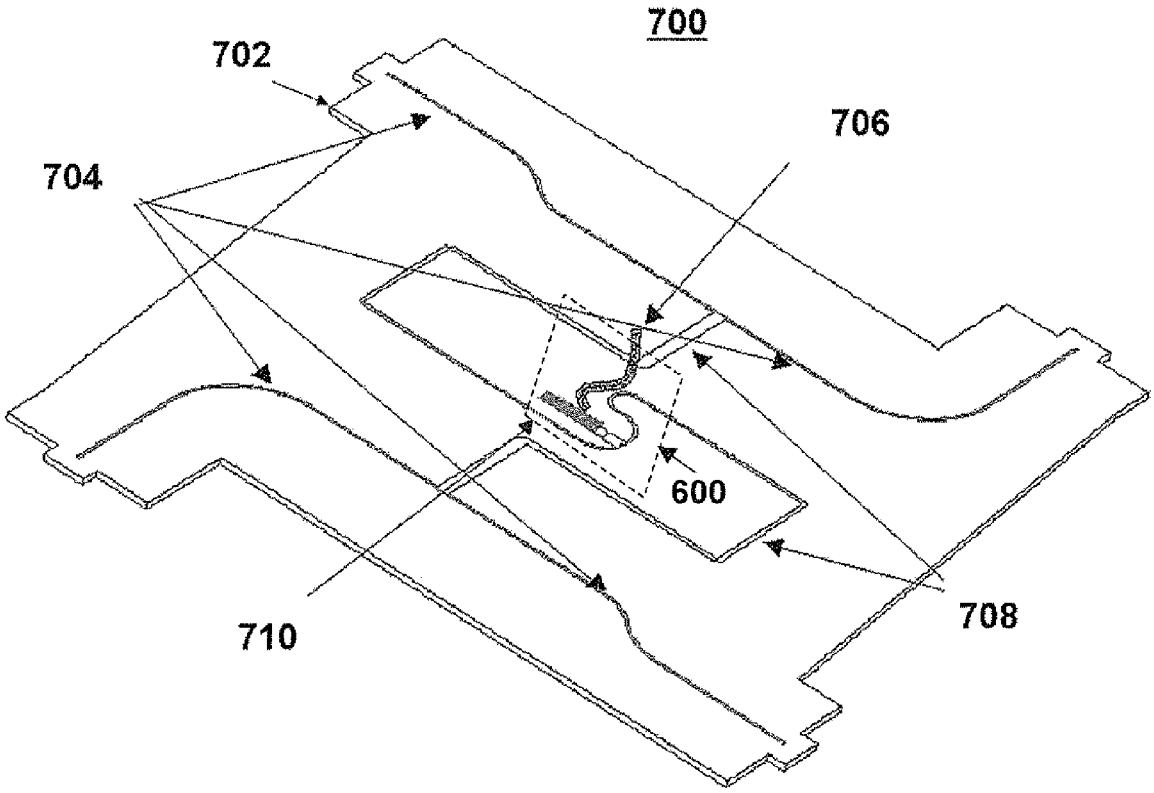
FIG. 7 shows a feeding plate used to feed the high band section and the low band section via the diplexer; and feeds each MSE radiator via a 50-to-100 Ohm printed transformer.

FIG. 7 shows a feeding plate 700 used to feed the high band section and the low band section via diplexer 600. Feeding plate 700 includes feeding lines 704 used to feed the MSE radiators via feeding points 408 (FIG. 4) and 504 (FIG. 5). The feeding lines are designed to preferably exhibit an impedance of 100 Ohm, which is preferably also the impedance of each MSE radiator. The impedance of the feeding lines is converted to preferably 50 Ohm through a 100-to-50 ohm in tapered transformer 708 printed on the feeding plate. A feature 710 shows the area where the diplexer is mounted and a feature 706 is the physical representation of transmission line 606 of FIG. 6. The material of the feeding, plate is preferably a low cost material such as 1.6 mm 1OZ FR-4. However, any other printed circuit material can also be used, Table II provides details of the performance of a preferred embodiment of the indoor antenna of the present invention.

TABLE II

| Frequency ranges, Gain and Polarization | Frequency Band (MHz) | Gain | Polarization |
|---|---|---|---|
| Electrical | | | |
| The Gain is specified for defined polarization at: minus 12 degrees refer to the horizon | 608-614 | 1.5 dbi | LHP |
| | 806-960 | 1 dbi | LHP or Linear Vertical |
| LHP = left hand circular polarization (elliptical-horizontal component is higher then vertical component) | 1395-1432 | 1 dbi | LHP |
| | 1710-2170 | 1 dbi | Elliptical Vertical |
| | 2400-2690 | 2 dbi | Elliptical Vertical |
| | 4900-6000 | 4 dbi | Elliptical Vertical |
| Max VSWR | | 2:1 | |
| Azimuth at 3 db beam width | | Omni-directional | |
| Zenith Null Width | | −20 db@ +/− 15 deg<br>−10 db@ =/− 20 deg | |
| Gain Ripple | | +/−1.5 db | |
| Input Impedance | | 50 (Ohm) | |
| Handling Power | | 2 Watt | |
| Mechanical | | | |
| Max Height | | 5.5" | |
| Max Diameter | | 11" | |

Figure 8:
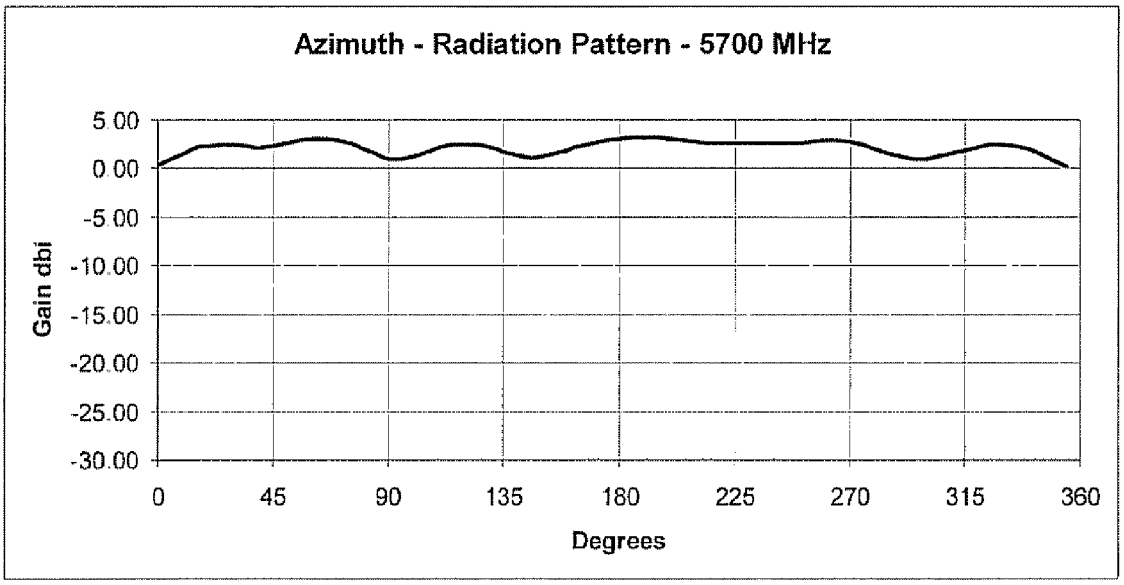
FIG. 8 shows simulated results of the radiation patern of the high band section in the azimuth plane.
Figure 9:
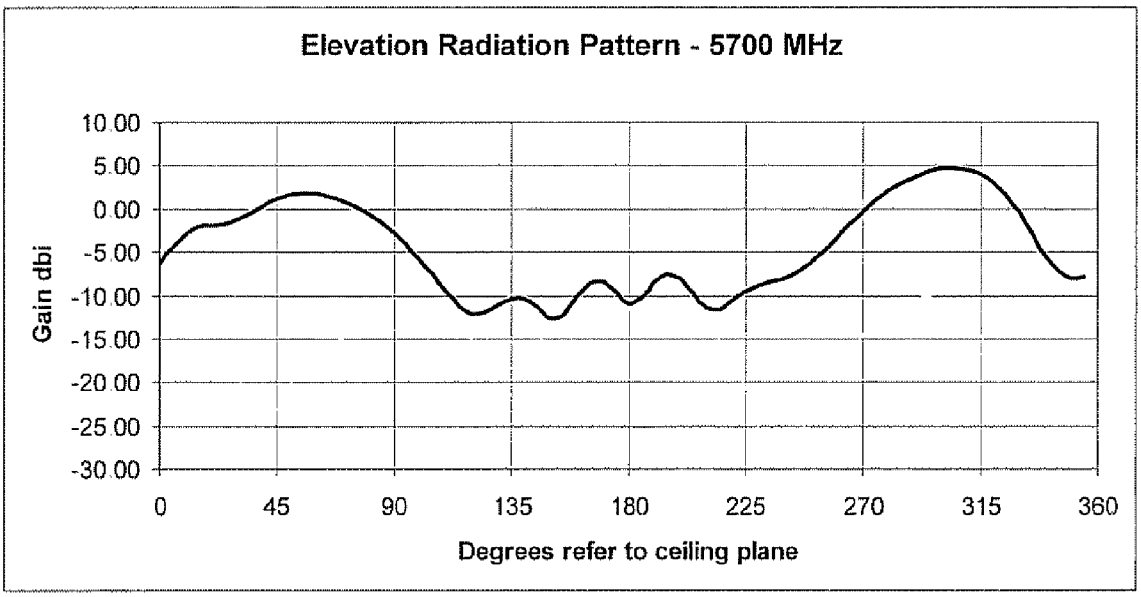
FIG. 9 shows simulated results of the performance of the radiation patern of the high band section in the elevation plane.

The simulated performance of the BFM on its around plane is shown in FIG. 8 (azimuth radiation) and FIG. 9 (elevation radiation). It can be seen that a very omni-directional radiation pattern has been achieved (FIG. 8) and that high gain in exhibited relatively far from the antenna (FIG. 9).

In summary, the present invention discloses a novel indoor antenna with elliptical/circular polarization and with a significant horizontal component. Sections of the antenna provide by themselves antenna action with novel and improved features over previously known antennas.

All publications and patents mentioned in this specification are incorporated herein in their entirety by reference into the specification, to the same extent as if each individual publication or patent was specifically and individually indicated to be incorporated herein by reference. In addition, citation or identification of any reference in this application shall not be construed as an admission that such reference is available as prior art to the present invention.

While the invention has been described with respect to a limited number of embodiments, it will be appreciated that many variations, modifications and other applications of the invention may be made.

What is claimed is:

1. A wide band indoor antenna comprising:

a. a low band section that includes four modified spiral element (MSE) radiators used for operation in a low frequency band;

b. a high band section having a bent folded monopole (BFM) radiator mounted on a ground plane and used for operation in a higher frequency band than the low frequency band, wherein both the low frequency band and the high frequency band are included in the wide band; and c. a feeding plate for feeding the low band section and the high band section via a diplexer.

2. The antenna of claim 1, wherein the wide band extends from about 600 MHz to about 6000 MHz.

3. The antenna of claim 2, wherein the low frequency band extends from about 600 MHz to about 1700 MHz and wherein the high frequency band extends from about 1700 MHz to about 6000 MHz.

* * * * *